US005458191A

United States Patent [19]

Chiang et al.

[11] Patent Number: 5,458,191

[45] Date of Patent: Oct. 17, 1995

[54] HEAT TRANSFER TUBE

[75] Inventors: Robert H. L. Chiang, Manlius; Jack L. Esformes, Syracuse, both of N.Y.

[73] Assignee: Carrier Corporation, Syracuse, N.Y.

[21] Appl. No.: 273,065

[22] Filed: Jul. 11, 1994

[51] Int. Cl.[6] ..... F28F 13/02

[52] U.S. Cl. ..... 165/133; 165/184

[58] Field of Search ..... 165/133, 184

[56] References Cited

U.S. PATENT DOCUMENTS

| | | | |
|---|---|---|---|
| 3,273,599 | 8/1966 | Heeren | 138/38 |
| 3,326,283 | 6/1967 | Ware | 165/181 |
| 3,861,462 | 1/1975 | McLain | 165/179 |
| 3,885,622 | 5/1975 | McLain | 165/179 |
| 4,245,695 | 1/1981 | Fujikake | 165/133 |
| 4,658,892 | 4/1987 | Shinohara et al. | 165/133 |
| 4,715,436 | 12/1987 | Takchashi et al. | 165/133 |
| 4,733,698 | 3/1988 | Sato | 138/38 |
| 5,052,476 | 10/1991 | Sukamoda et al. | 165/133 |
| 5,070,937 | 12/1991 | Mougin et al. | 165/133 |
| 5,332,034 | 7/1994 | Chiang et al. . | |

FOREIGN PATENT DOCUMENTS

| | | | |
|---|---|---|---|
| 54-157369 | 12/1979 | Japan | 165/184 |
| 3207995 | 9/1991 | Japan | 165/184 |
| 43892 | 1/1992 | Japan | 165/184 |

*Primary Examiner*—Allen J. Flanigan

[57] ABSTRACT

A heat transfer tube having an internal surface that enhances the heat transfer performance of the tube. Helical ribs project from the internal surface of the tube. The ribs have a pattern of parallel notches intersecting and impressed into them at a small angle of inclination with respect to the longitudinal axis. The pattern of ribs and notches increase the total internal surface area of the tube and also promote conditions for the flow of refrigerant within the tube that increase heat transfer performance. The tube is suitable for use in both refrigerant evaporators and condensers.

7 Claims, 2 Drawing Sheets

HEAT TRANSFER TUBE

BACKGROUND OF THE INVENTION

This invention relates generally to tubes used in heat exchangers for transferring heat between a fluid inside the tube and a fluid outside the tube. More particularly, the invention relates to a heat transfer tube having an internal surface that is capable of enhancing the heat transfer performance of the tube. Heat exchangers of air conditioning and refrigeration (AC&R) or similar systems contain such tubes.

Designers of heat transfer tubes have long recognized that the heat transfer performance of a tube having surface enhancements is superior to a smooth walled tube. Manufacturers have applied a wide variety of surface enhancements to both internal and external tube surfaces including ribs, fins, coatings and inserts, to name just a few. Common to nearly all enhancement designs is an attempt to increase the heat transfer area of the tube. Most designs also attempt to encourage turbulence in the fluid flowing through or over the tube in order to promote fluid mixing and break up the boundary layer at the surface of the tube.

A large percentage of AC&R, as well as engine cooling, heat exchangers are of the plate fin and tube type. In such heat exchangers, plate fins affixed to the exterior of the tubes are the tube external enhancements. The heat transfer tubes frequently also have internal heat transfer enhancements on the interior wall of the tube.

Many prior art internal surface enhancements in metal heat transfer tubes are ribs formed by working the tube wall in some way. Such ribs frequently run in a helical pattern around the tube surface. This is a prevalent configuration because helical rib patterns are usually relatively easier to form than other types of rib patterns. Thorough mixing, turbulent flow and the greatest possible internal heat transfer surface area are desirable to promote heat transfer effectiveness. However, high rib heights and rib helix angles can result in flow resistance that is so high that flow pressure losses become unacceptable. Excessive pressure losses require excessive pumping power and an overall degradation of system efficiency. Tube wall strength and integrity are also considerations in how to configure an internal surface enhancement.

As is implicit in their names, the fluid flowing through a condenser undergoes a phase change from gas to liquid and the fluid flowing through an evaporator changes phase from a liquid to a gas. Heat exchangers of both types are needed in vapor compression AC&R systems. In order to simplify acquisition and stocking as well as to reduce costs of manufacturing, it is desirable that the same type of tubing be used to in all the heat exchangers of a system. But heat transfer tubing that is optimized for use in one application frequently does not perform as well when used in the other application. To obtain maximum performance in a given system under these circumstances, it would be necessary to use two types of tubing, one for each functional application. But there is at least one type of AC&R system where a given heat exchanger must perform both functions, i.e. a reversible vapor compression or heat pump type air conditioning system. It is not possible to optimize a given heat exchanger for a single function in such a system and the heat transfer tube selected must be able to perform both functions well.

In a significant proportion of the total length of the tubing in a typical plate fin and tube AC&R heat exchanger, the flow of refrigerant flow is mixed, i.e., the refrigerant exists in both liquid and vapor states. Because of the variation in density, the liquid refrigerant flows along the bottom of the tube and the vaporous refrigerant flows along the top. Heat transfer performance of the tube is improved if there is improved intermixing between the fluids in the two states, e.g. by promoting drainage of liquid from the upper region of the tube in a condensing application or encouraging liquid to flow up the tube inner wall by capillary action in an evaporating application.

To obtain improved heat transfer performance as well as to simplify manufacturing and reduce costs, what is needed is an heat transfer tube that has a heat transfer enhancing interior surface that is simple to produce, has at least an acceptably low resistance to fluid flow and can perform well in both condensing and evaporating applications. The interior heat transfer surface must be readily and inexpensively manufactured.

SUMMARY OF THE INVENTION

The heat transfer tube of the present invention has an internal surface that is configured to enhance the thermal performance of the tube. The internal enhancement is a fibbed internal surface with the helical ribs running at an angle to the longitudinal axis of the tube. The ribs have a pattern of parallel notches impressed into them. The pattern of the notches runs at a small angle to the longitudinal axis of the tube. The configuration of the internal surface increases its area and thus increases the heat transfer performance of the tube. In addition, the notched fibs promote flow conditions within the tube that promote heat transfer but not to such a degree that flow losses through the tube are excessive. The configuration of the enhancement gives improved heat transfer performance both in a condensing and an evaporating application. In the region of a plate fin and tube heat exchanger constructed of tube embodying the present invention where the flow of fluid is of mixed states and has a high vapor content, the configuration promotes turbulent flow at the internal surface of tube and thus serves to improve heat transfer performance. In the regions of the heat exchanger where there is a low vapor content, the configuration promotes both condensate drainage in a condensing environment and capillary movement of liquid up the tube walls in a evaporating environment.

While the tube of the present invention may be made by a variety of manufacturing processes, it is particularly adaptable to manufacturing from a copper or copper alloy strip by roll embossing the enhancement pattern on one surface on the strip before roll forming and seam welding the strip into tubing. Such a manufacturing process is capable of rapidly and economically producing internally enhanced heat transfer tubing.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
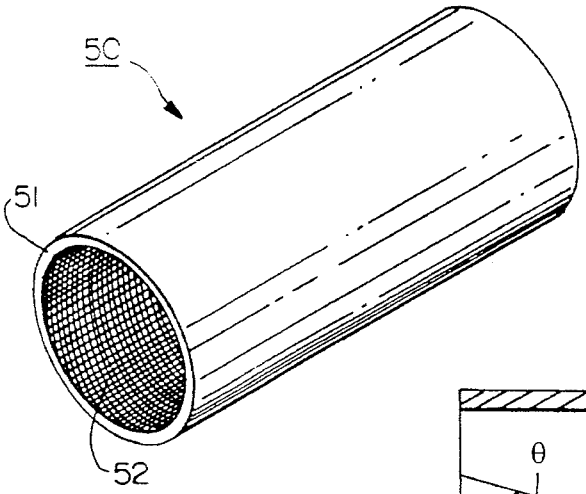
FIG. 1 is a pictorial view of the heat transfer tube of the present invention.

FIG. 1 shows, in an overall isometric view, the heat transfer tube of the present invention. Tube 50 has tube wall 51 upon which is internal surface enhancement 52.

Figure 2:
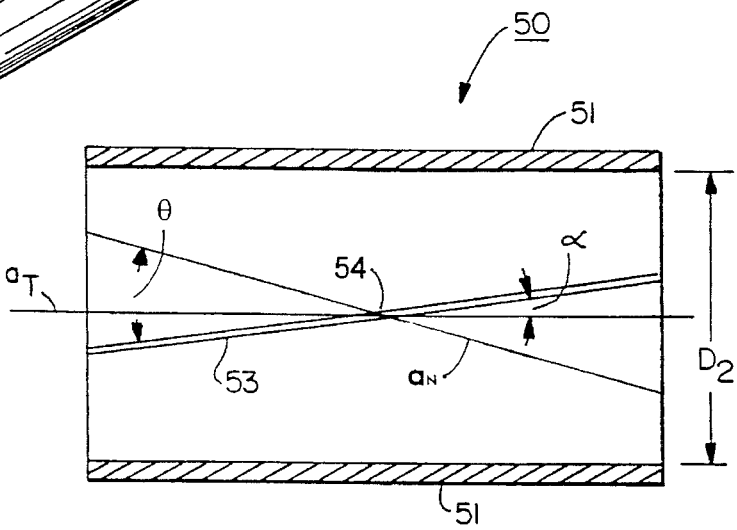
FIG. 2 is a sectioned elevation view of the heat transfer tube of the present invention.

FIG. 2 depicts heat transfer tube 50 in a cross sectioned elevation view. Only a single rib 53 and a single notch 54 of surface enhancement 52 (FIG. 1) is shown in FIG. 2 for clarity, but in the tube of the present invention, a plurality of ribs 53[, all parallel to each other,] extend out from wall 51 of tube 50. Rib 53 is inclined at helix angle $\alpha$ from tube longitudinal axis $a_T$. Notch axis $a_N$ is inclined at angle $\theta$ from ribs 53. Tube 10 has internal diameter, as measured from the internal surface of the tube between ribs, $D_2$ .

Figure 3:
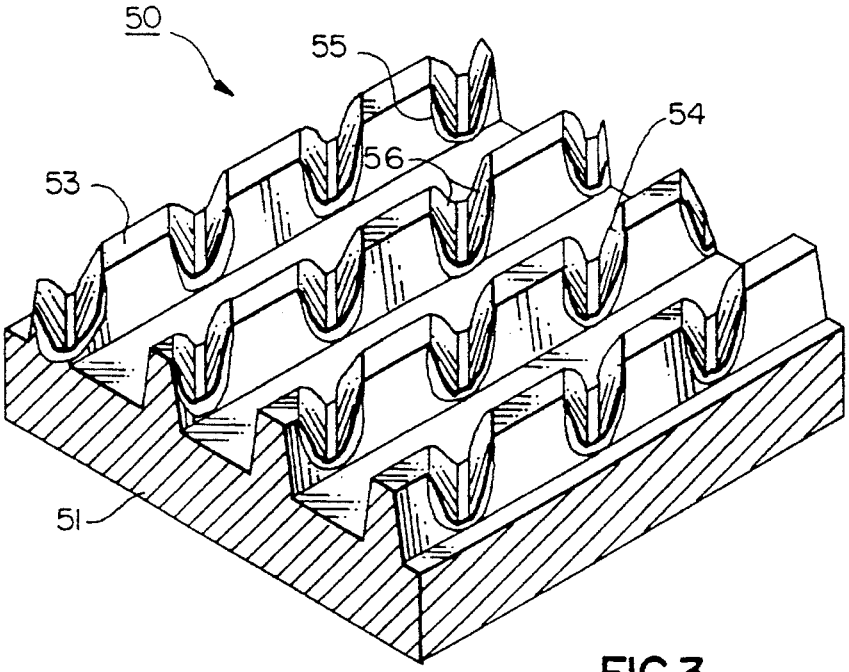
FIG. 3 is an isometric view of a section of the wall of the heat transfer tube of the present invention.

FIG. 3 is an isometric view of a portion of wall 51 of heat transfer tube 50 depicting details of surface enhancement 52. Extending outward from wall 51 are a plurality of helical ribs 53. At intervals along the ribs are a series of notches 54. As will be described below, notches 54 are formed in fibs 53 by a rolling process. The material displaced as the notches are formed is left as a projection 55 that projects outward from each side of a given rib 53 around each notch 54 in that rib. The projections have a salutary effect on the heat transfer performance of the tube, as they both increase the surface area of the tube exposed to the fluid flowing through the tube and also promote turbulence in the fluid flow near the tube inner surface.

Figure 4:
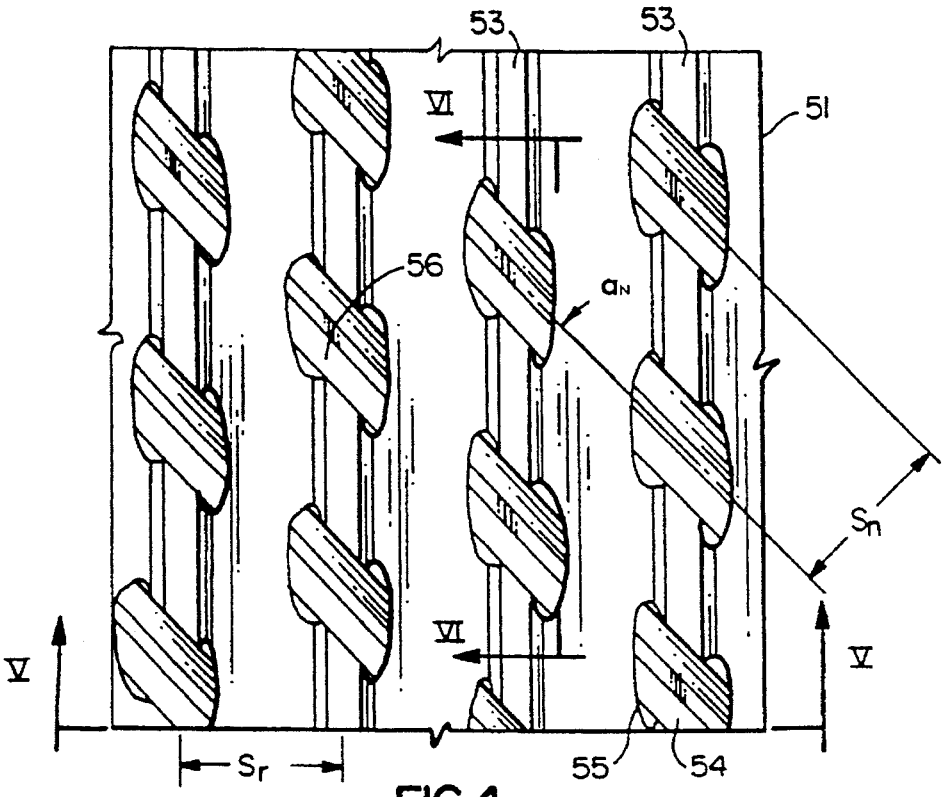
FIG. 4 is a plan view of a section of the wall of the heat transfer tube of the present invention.

FIG. 4 is a plan view of a portion of wall 51 of tube 50. The figure shows ribs 53 disposed on the wall at rib spacing $S_r$. Notches 54 are impressed into the ribs at notch interval $S_n$. The angle of incidence between the notches and the ribs is angle $\theta$.

Figure 5:
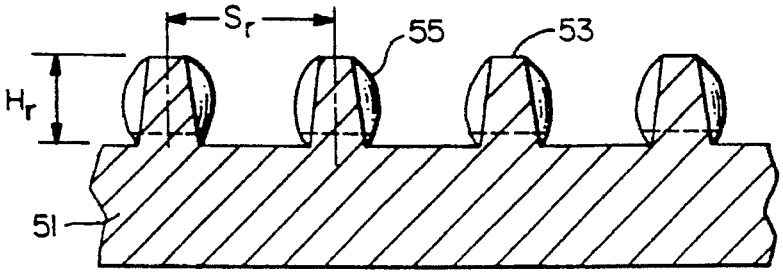
FIG. 5 is a section view of the wall of the heat transfer tube of the present invention taken through line V—V in FIG. 4.

FIG. 5 is a section view of wall 51 taken through line V—V in FIG. 4. The figure shows that ribs 53 have height $H_r$ and have rib spacing $S_r$.

Figure 6:
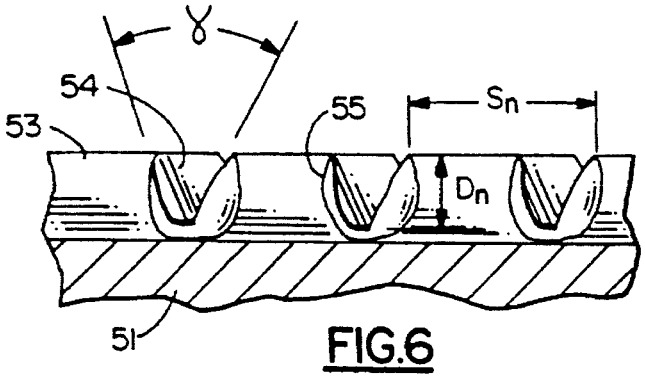
FIG. 6 is a section view of the wall of the heat transfer tube of the present invention taken through line VI—VI in FIG. 4.

FIG. 6 is a section view of wall 51 taken through line VI—VI in FIG. 4. The figure shows that notches 54 have an angle between opposite notch faces 56 of It and are impressed into ribs 54 to a depth of $D_r$. The interval between adjacent notches is $S_n$.

For optimum heat transfer consistent with minimum fluid flow resistance, a tube embodying the present invention and having a nominal outside diameter of 20 mm (¾ inch) or less should have an internal enhancement with features as described above and having the following parameters:

a. the rib helix angle should be between five and 45 degrees, or $$5° \leqq \alpha \leqq 45°;$$

b. the ratio of the rib height to the inner diameter of the tube should be between 0.015 and 0.03, or $$.015 \leqq H_r/D_2 \leqq 0.03;$$

c. the number of ribs per unit length of tube inner diameter should be between 10 and 24 per centimeter (26 and 60 per inch);

d. the angle of incidence between the notch axis and the [helical ribs] longitudinal axis of the tube should be less than 15 degrees, or $$\theta < 15°$$

and preferably less than eight degrees;

e. the ratio between the interval between notches in a rib and the tube inner diameter should be between 0.025 and 0.1, or $$.025 \leqq S_n/D_i \leqq 0.1;$$

f. the angle between the opposite faces of a notch should be less than 90 degrees, or $$\gamma < 90°; \text{ and}$$

g. the notch depth should be at least 40 percent of the rib height, or $$D_n/H_r \geqq 0.4.$$

Enhancement 52 may be formed on the interior of tube wall 51 by any suitable process. In the manufacture of seam welded metal tubing using modern automated high speed processes, an effective method is to apply the enhancement pattern by roll embossing on one surface of a metal strip before the strip is roll formed into a circular cross section and seam welded into a tube. If the tube is manufactured by roll embossing, roll forming and seam welding, it is likely that there will be a region along the line of the weld in the finished tube that either lacks the enhancement configuration that is present around the remainder of the tube inner circumference, due to the nature of the manufacturing process, or has a different enhancement configuration. This region of different configuration will not adversely affect the thermal or fluid flow performance of the tube in any significant way.

We claim:

1. An improved heat transfer tube (50) having a wall (51) having an inner surface, a longitudinal axis ($a_T$) and a plurality of helical ribs (53) formed on said inner surface, in which the improvement comprises:

a pattern of parallel notches (54) impressed into said ribs at an angle ($\theta$) of inclination from said ribs of no greater than 15 degrees, said notches having an angle between opposite faces (56) of less than 90 degrees, and a pitch ($S_n$) of between 0.5 and 2.0 millimeters (0.02 and 0.08 inch).

2. The heat transfer tube of claim 1 in which said angle of inclination from said longitudinal axis is less than eight degrees.

3. The heat transfer tube of claim 1 in which the ratio ($H_r/D_2$) between the height ($H_r$) of said ribs and the inner diameter ($D_2$) of said tube is between between 0.015 and 0.03.

4. The heat transfer tube of claim 1 in which the rib helix angle ($\alpha$) is between five and 45 degrees.

5. The heat transfer tube of claim 1 in which the number of ribs per unit length of inner tube circumference ($\pi D_i$) is between 10 and 24 per centimeter (26 and 60 per inch).

6. The heat transfer tube of claim 1 in which the ratio ($D_n/H_r$) of notch depth ($D_n$) to rib height ($H_r$) is at least 0.4.

7. The heat transfer tube of claim 1 in which a projection (55), comprised of material displaced from a rib as a notch is formed in said rib, extends outward from said opposite sides of said rib in the vicinity of each notch in said rib.

* * * * *